US007257962B2

(12) United States Patent
Son

(10) Patent No.: US 7,257,962 B2
(45) Date of Patent: Aug. 21, 2007

(54) ICE TRANSFER DEVICE FOR REFRIGERATOR

(75) Inventor: Sung Koo Son, Masan-si (KR)

(73) Assignee: LG Electronics Inc., Seoul (KR)

( * ) Notice: Subject to any disclaimer, the term of this patent is extended or adjusted under 35 U.S.C. 154(b) by 143 days.

(21) Appl. No.: 11/041,988

(22) Filed: Jan. 26, 2005

(65) Prior Publication Data

US 2005/0166627 A1 Aug. 4, 2005

(30) Foreign Application Priority Data

Jan. 30, 2004 (KR) ..... 10-2004-0006318

(51) Int. Cl.
*F25C 1/12* (2006.01)

(52) U.S. Cl. ..... 62/344; 62/353

(58) Field of Classification Search ..... 62/344, 62/353; 222/146.6

See application file for complete search history.

(56) References Cited

U.S. PATENT DOCUMENTS 5,037,004 A * 8/1991 Katz et al. ..... 222/146.6
6,637,217 B2 * 10/2003 Kim et al. ..... 62/125

FOREIGN PATENT DOCUMENTS

JP 51-148755 11/1976

* cited by examiner

*Primary Examiner*—William E. Tapolcai
(74) *Attorney, Agent, or Firm*—Ked & Associates, LLP

(57) ABSTRACT

An ice transfer device for a refrigerator is provided. An ice-making part is provided at an upper portion of an ice maker of the refrigerator, and a storage container is provided below the ice-making part. Both edges of a bottom surface of the storage container are rounded, and a transfer member for transferring ice is provided within the storage container. Further, a motor is installed in the vicinity of one of the rounded edges of the storage container and has a motor shaft protruding toward the rear of the ice maker. A gearbox provided at the rear of the storage container has a driving shaft protruding toward the front of the ice maker. With this construction, the inner space of the refrigerator can be efficiently used.

11 Claims, 3 Drawing Sheets

ICE TRANSFER DEVICE FOR REFRIGERATOR

BACKGROUND OF THE INVENTION

1. Field of the Invention

The present invention relates to a refrigerator, and more particularly, to an ice transfer device for a refrigerator, which can transfer ice made in an ice maker to a dispenser in the refrigerator.

2. Description of the Related Art

A conventional ice transfer device for a refrigerator will be described with reference to the accompanying drawings.

FIG. 1 shows a refrigerator with a conventional ice transfer device, and FIG. 2 is an enlarged view of the ice transfer device shown in FIG. 1.

As shown in these figures, a refrigerator body 1 is provided with a freezing chamber 3 for storing foodstuffs that is selectively opened or closed by a door 5. Further, a dispenser 7 is provided at a side of a front face of the door 5, and an ice maker 10 is installed at an upper portion of the freezing chamber 3.

As shown in FIG. 2, an ice-making part 11 for making ice i is provided at an upper portion of the ice maker 10. A storage container 13 for storing the ice i, which has been made by the ice-making part 11, is installed at a lower portion of the ice maker 10 that is below the ice-making part 11.

Meanwhile, a transfer member 15 for pushing stored ice i toward the front of the ice maker 10 is provided within the storage container 13. The transfer member 15 is formed helically and rotated by a motor 17 installed at the rear of the storage container 13. At this time, the motor 17 is arranged such that a motor shaft 17' is directed to the front of the ice maker 10.

A gearbox 19 is also provided between the transfer member 15 and the motor 17. The gearbox 19 comprises a plurality of gears to function to transmit increased driving torque to the transfer member 15 while reducing the driving speed of the motor 17. The gearbox 19 has a driving shaft 19' that is directed to the front of the ice maker 10 in the same manner as the motor shaft 17'. The gearbox 19 is connected to the transfer member 15 and the motor 17 by the driving shaft 19' and the motor shaft 17', respectively.

An ice-crushing member 21 is provided at a front end of the transfer member 15. The ice-crushing member 21 is to crush the ice i that is transferred to the front of the ice maker 10 by the transfer member 15. A delivery part 23 for delivering crushed ice i to the outside through the dispenser 7 is provided below the ice-crushing member 21.

However, the conventional ice transfer device for the refrigerator constructed as above has the following problems.

As described above, the motor 17 is conventionally installed at the rear of the storage container 13. Thus, there is a need for a space for the installation of the motor 17, which corresponds to the size of the motor 17, at the rear of the storage container 13. Since such a space is outside the storage container 13, it becomes a dead space in which ice i as well as foodstuffs cannot be stored. That is, the conventional ice transfer device has a disadvantage in that the space cannot be efficiently used.

SUMMARY OF THE INVENTION

Accordingly, the present invention is conceived to solve the problems in the prior art. An object of the present invention is to provide an ice transfer device for a refrigerator, which is constructed to improve the efficiency of use of a space.

According to the present invention for achieving the object, there is provided an ice transfer device for a refrigerator, comprising: a storage container that is installed within the refrigerator to contain ice therein; a motor that is installed close to the storage container and has a motor shaft protruding in a direction opposite to a direction of transfer of the ice; a gearbox which is installed at a side opposite to a part for delivering the ice contained in the storage container to the outside and has a driving shaft protruding in the transfer direction of the ice to transmit a driving force while reducing a driving speed of the motor and to which the motor shaft is connected; and a transfer member that is installed within the storage container and connected to the driving shaft to push the ice forward by means of the driving of the motor.

The motor may be placed at a position outside the storage container, wherein the position is included in a sectional area of the gearbox orthogonal to the transfer direction of the ice.

At least one of edges of a bottom surface of the storage container may be rounded, and the motor may be installed in the vicinity of the rounded edge of the storage container.

With the ice transfer device for the refrigerator according to the present invention, there is an advantage in that the space of the refrigerator can be efficiently used.

BRIEF DESCRIPTION OF THE DRAWINGS

The above and other objects, features and advantages of the present invention will become apparent from the following description of a preferred embodiment given in conjunction with the accompanying drawings, in which.

DESCRIPTION OF THE PREFERRED EMBODIMENT

Hereinafter, a preferred embodiment of the present invention will be described in detail with reference to the accompanying drawings.

Figure 3:
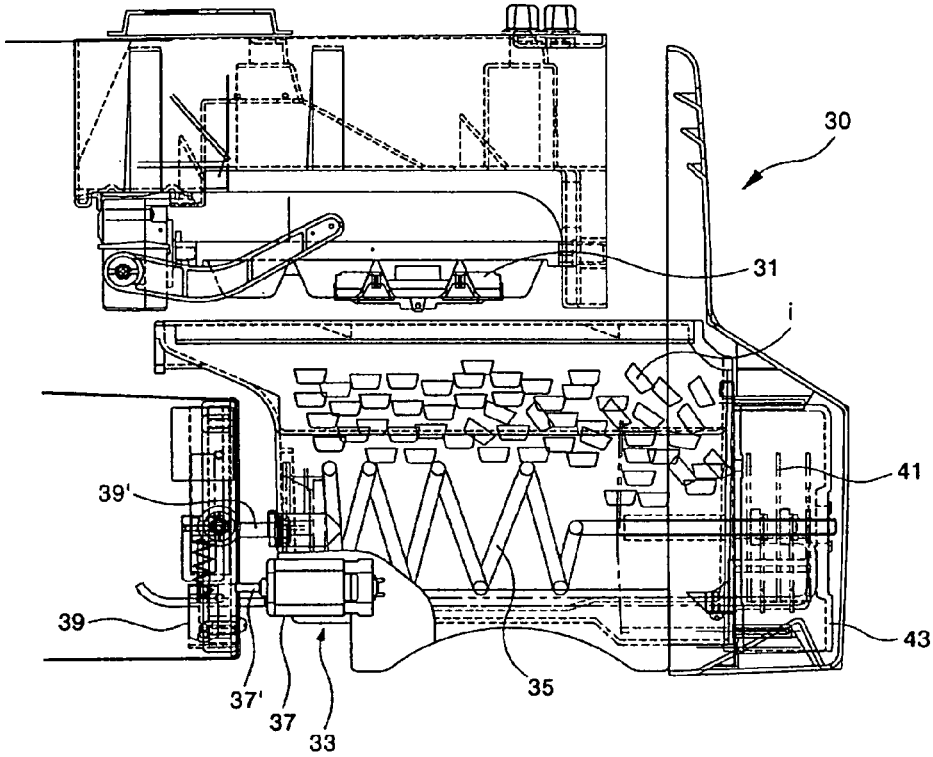
FIG. 3 is a sectional side view of an ice transfer device according to a preferred embodiment of the present invention.
Figure 4:
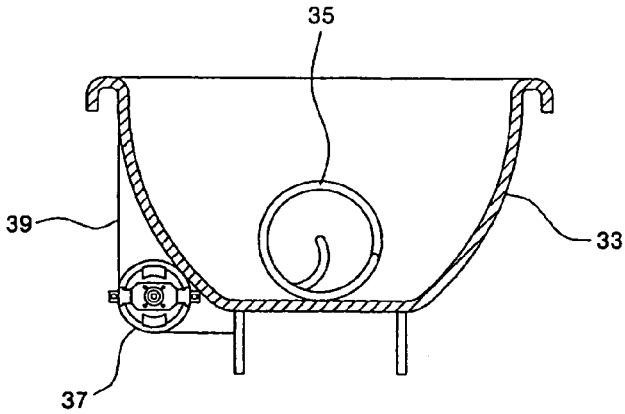
FIG. 4 is a front sectional view of the ice transfer device of the embodiment shown in FIG. 3.

FIGS. 3 and 4 show an ice transfer device for a refrigerator according to the preferred embodiment of the present invention.

As shown in these figures, an ice-making part 31 for making ice i is provided at an upper portion of an ice maker 30, and a storage container 33 is provided below the ice-making part 31. The storage container 33 is to store the ice i that has been made by the ice-making part 31. Both edges of a bottom surface of the storage container 33 are rounded as shown in FIG. 4.

Meanwhile, a transfer member 35 is provided within the storage container 33. The transfer member 35 is to push ice i, which has been stored in the storage container 33, toward the front of the ice maker 30. The transfer member 35 is installed to extend in a fore and aft direction in the vicinity of the bottom surface of the storage container 33. The transfer member 35 is helically formed and pushes the ice i while being rotated.

Further, a motor 37 for rotating the transfer member 35 is provided. The motor 37 is installed close to one of the rounded edges of the storage container 33. The motor 37 has a motor shaft 37' that protrudes toward the rear of the ice maker 30, i.e. in a direction opposite to the transfer direction of the ice i. At this time, it is preferred that a DC motor relatively smaller than a conventional AC motor be used as the motor 37.

A gearbox 39 comprising a plurality of gears is installed at the rear of the storage container 33. The gearbox 39 functions to transmit increased driving torque to the transfer member 35 while reducing the driving speed of the motor 37. The gearbox 19 is connected to the transfer member 35 and the motor 37 by a driving shaft 39', which protrudes at the front thereof toward the front of the ice maker 30, i.e. in the transfer direction of the ice i, and the motor shaft 37', respectively.

Figure 1:
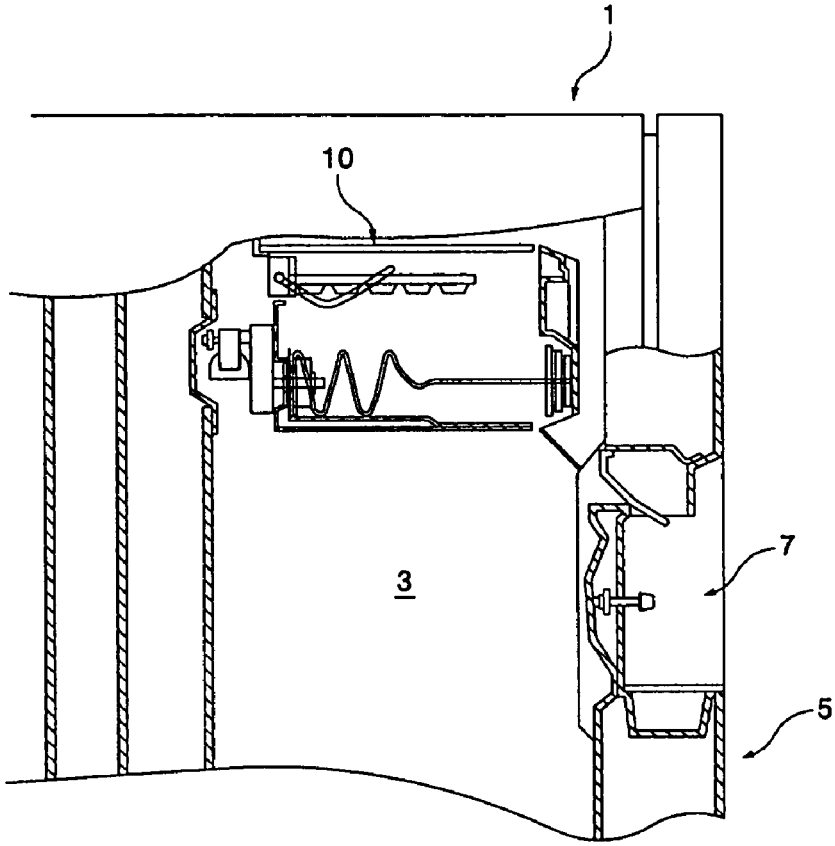
Fig.1 PRIOR ART
FIG. 1 is a sectional side view of a portion of a refrigerator with a conventional ice transfer device.
Figure 2:
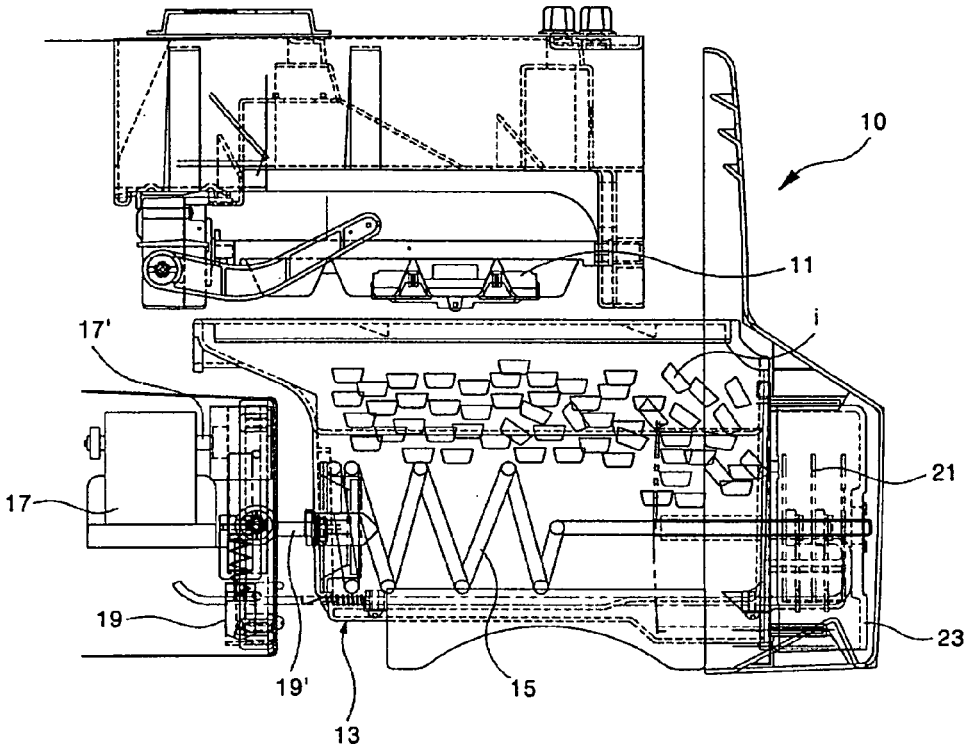
Fig.2 PRIOR ART
FIG. 2 is an enlarged view of the ice transfer device shown in FIG. 1.

An ice-crushing member 41 is provided at a front end of the transfer member 35. The ice-crushing member 41 is to crush the ice i that is moved to the front of the storage container 33 by the transfer member 35. A delivery part 43 is provided below the ice-crushing member 41 to deliver crushed ice i through the dispenser 7 (see FIG. 1).

Next, the operation of the ice transfer device for the refrigerator according to the preferred embodiment of the present invention will be described.

As for the process of delivering ice i in the ice maker 30, ice i made by the ice-making part 31 first falls down and is stored in the storage container 33. When a user manipulates the dispenser 7, the motor 37 is operated. With the operation of the motor 37, the transfer member 35 is rotated and pushes the ice i to the front of the ice maker 30.

Meanwhile, the ice i that has been moved to the front of the ice maker 30 by the transfer member 35 is crushed by the ice-crushing member 41. The ice i, which has been crushed to certain sizes by the ice-crushing member 41, is delivered through the dispenser 7 via the delivery part 43 provided below the ice-crushing member 41.

At this time, the motor 37 is installed below the storage container 33 in the vicinity of one of the rounded edges of the storage container 33, and only the gearbox 39 is installed at the rear of the storage container 33. Thus, it is possible to minimize the size of a space formed between the ice maker 30 and a back surface of the freezing chamber 3 (see FIG. 1) in which the ice maker 30 is installed.

According to the present invention described above, it can be understood that the fundamental technical spirit of the present invention is that the motor shaft of the motor for driving the ice transfer device and the driving shaft of the gearbox for increasing the driving torque of the motor protrude in opposite directions.

It will be apparent that those skilled in the art can make other modifications within the fundamental technical spirit of the present invention. The scope of the present invention should be construed based on the appended claims.

In the illustrated embodiment, the edges of the bottom surface of the storage container are rounded to accommodate the motor at one side of the bottom surface of the storage container, and the motor is installed in the vicinity of the rounded edge of the storage container. As a modified structure capable of accommodating the motor at the side of the bottom surface of the storage container in the present invention, the edges of the bottom surface of the storage container may be recessed to conform to the shape of the motor. Therefore, the formation of the recessed edges in the bottom surface of the storage container is covered by the meaning of rounding the edges of the bottom surface of the storage container.

With the ice transfer device for the refrigerator according to the present invention described above, the formation of an unnecessary space in the interior of the refrigerator can be minimized, thereby improving the efficiency of use of a space.

Particularly, in the ice transfer device for the refrigerator according to the present invention, the motor is installed in the vicinity of the rounded edge of the storage container in a state where the motor shaft is caused to protrude in the direction opposite to the transfer direction of ice, thereby eliminating a dead space that otherwise may be formed behind the back surface of the storage container due to the installation of the motor, and contributing to-increase in the volume of the storage container.

What is claimed is:

1. An ice transfer device for a refrigerator, comprising:

a storage container installed within the refrigerator configured to contain ice therein;

a motor installed adjacent to the storage container and having a motor shaft protruding in a direction opposite to a direction of transfer of the ice;

a gearbox installed at a side opposite to a part for delivering the ice contained in the storage container to the outside and having a driving shaft protruding in the transfer direction of the ice to transmit a driving force while reducing a driving speed of the motor, the motor shaft being connected to the gearbox; and a transfer member installed within the storage container and connected to the driving shaft to push the ice forward by means of the driving of the motor, wherein the motor is disposed adjacent an outer wall of the storage container.

2. The device as claimed in claim 1, wherein the motor is placed at a position outside the storage container, the position being included in a sectional area of the gearbox orthogonal to the transfer direction of the ice.

3. The device as claimed in claim 1, wherein at least one of edges of a bottom surface of the storage container is rounded, and the motor is installed in the vicinity of the rounded edge of the storage container.

4. The device as claimed in claim 2, wherein at least one of edges of a bottom surface of the storage container is rounded, and the motor is installed in the vicinity of the rounded edge of the storage container.

5. The device as claimed in claim 1, wherein the motor comprises a DC motor.

6. The device as claimed in claim 1, wherein the motor is disposed adjacent a bottom outer wall of the storage container.

7. An ice transfer device for a refrigerator, comprising:

a storage container installed within the refrigerator configured to contain ice therein;

a motor installed adjacent to the storage container and having a motor shaft protruding in a direction opposite to a direction of transfer of the ice;

a gearbox installed at a side opposite to a part for delivering the ice contained in the storage container to the outside and having a driving shaft protruding in the transfer direction of the ice to transmit a driving force while reducing a driving speed of the motor, the motor shaft being connected to the gearbox; and a transfer member installed within the storage container and connected to the driving shaft to push the ice forward by means of the driving of the motor, wherein the motor is disposed below the storage container within a length of the storage container.

8. The device as claimed in claim 7, wherein the motor is placed at a position outside the storage container, the position being included in a sectional area of the gearbox orthogonal to the transfer direction of the ice.

9. The device as claimed in claim 8, wherein at least one of edges of a bottom surface of the storage container is rounded, and the motor is installed in the vicinity of the rounded edge of the storage container.

10. The device as claimed in claim 7, wherein at least one of edges of a bottom surface of the storage container is rounded, and the motor is installed in the vicinity of the rounded edge of the storage container.

11. The device as claimed in claim 7, wherein the motor comprises a DC motor.

* * * * *